US009896241B2

(12) United States Patent
Anzini et al.

(10) Patent No.: US 9,896,241 B2
(45) **Date of Patent: *Feb. 20, 2018**

(54) RECLOSABLE PACKAGE OR BAG WITH SCENTED ZIPPER

(75) Inventors: David J. Anzini, Middletown, NY (US); Rusty Koenigkramer, Nanuet, NY (US); Victor Matias, New Braunfels, TX (US); Eric Plourde, Frankfort, IL (US); Steven Ausnit, New York, NY (US); Jose Manuel Septien Rojas, Scarborough (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/385,324

(22) PCT Filed: Jul. 31, 2012

(86) PCT No.: PCT/US2012/048987

§ 371 (c)(1),
(2), (4) Date: Dec. 29, 2014

(87) PCT Pub. No.: WO2013/151572

PCT Pub. Date: Oct. 10, 2013

(65) Prior Publication Data

US 2015/0203251 A1 Jul. 23, 2015

Related U.S. Application Data

(63) Continuation-in-part of application No. PCT/US2012/032477, filed on Apr. 6, 2012.

(Continued)

(51) Int. Cl.

| | |
|---|---|
| ***B65D 33/25*** | (2006.01) |
| ***A44B 19/32*** | (2006.01) |
| ***A44B 19/26*** | (2006.01) |

(52) U.S. Cl.

CPC ..... *B65D 33/2508* (2013.01); *A44B 19/265* (2013.01); *A44B 19/32* (2013.01);

(Continued)

(58) Field of Classification Search

CPC ..... B65D 33/2508; B65D 33/25; B65D 2203/12; A44B 19/32; A44B 19/265; Y10T 24/2582; Y10T 24/158

See application file for complete search history.

(56) References Cited

U.S. PATENT DOCUMENTS

| | | | | |
|---|---|---|---|---|
| 4,791,710 | A | 12/1988 | Nocek et al. | |
| 4,947,525 | A * | 8/1990 | Van Erden | B65D 33/2516 156/66 |

(Continued)

FOREIGN PATENT DOCUMENTS

| | | |
|---|---|---|
| DE | 102009020524 | 11/2010 |
| EP | 1988034 | 11/2008 |

(Continued)

OTHER PUBLICATIONS

International Search Report of PCT/US2012/048987 dated Nov. 28, 2012.

(Continued)

*Primary Examiner* — Robert Sandy
*Assistant Examiner* — Louis A Mercado
(74) *Attorney, Agent, or Firm* — McCarter & English, LLP

(57) ABSTRACT

The zipper for a reclosable package wherein the zipper includes fragrance-carrying oil within an internal zipper volume or storage volume thereby confining the scent while the zipper and the package are closed. When the zipper is opened, the scent is allowed to escape to the consumer.

9 Claims, 7 Drawing Sheets

Related U.S. Application Data

(60) Provisional application No. 61/472,437, filed on Apr. 6, 2011, provisional application No. 61/476,390, filed on Apr. 18, 2011.

(52) U.S. Cl.
CPC ..... *B65D 33/25* (2013.01); *B65D 2203/12* (2013.01); *Y10T 24/158* (2015.01); *Y10T 24/2582* (2015.01)

(56) References Cited

U.S. PATENT DOCUMENTS

| | | | | |
|---|---|---|---|---|
| 5,351,369 | A * | 10/1994 | Swain | B65D 33/2541 24/304 |
| 6,004,032 | A | 12/1999 | Kapperman et al. | |
| 6,279,581 | B1 | 8/2001 | Knepper | |
| 7,282,195 | B2 * | 10/2007 | MacDougald | A61K 6/08 424/401 |
| 7,305,742 | B2 * | 12/2007 | Anderson | B31B 19/90 24/400 |
| 7,344,022 | B2 | 3/2008 | Madson | |
| 7,497,623 | B2 | 3/2009 | Thomas et al. | |
| 7,857,514 | B2 * | 12/2010 | Gaikwad et al. | B65B 31/04 24/30.5 R |
| 2004/0234170 | A1 | 11/2004 | Pawloski et al. | |
| 2005/0220374 | A1 | 10/2005 | Thomas et al. | |
| 2006/0093242 | A1 * | 5/2006 | Anzini | B65D 33/2591 383/63 |
| 2006/0204147 | A1 * | 9/2006 | Stolmeier | B65D 33/2591 383/5 |
| 2007/0235352 | A1 | 10/2007 | Madson | |
| 2007/0266532 | A1 * | 11/2007 | Katada | B65D 33/2533 24/399 |
| 2008/0172842 | A1 | 7/2008 | Blythe et al. | |
| 2008/0189913 | A1 * | 8/2008 | Bergman et al. | B65D 33/2541 24/30.5 L |
| 2008/0310772 | A1 | 12/2008 | Dayton et al. | |
| 2009/0214141 | A1 | 8/2009 | Borchardt et al. | |
| 2012/0045151 | A1 | 2/2012 | Eouzan | |

FOREIGN PATENT DOCUMENTS

| | | |
|---|---|---|
| GB | 841142 | 7/1960 |
| JP | 2008154767 | 7/2008 |
| WO | 03052033 | 6/2003 |

OTHER PUBLICATIONS

International Search Report of PC/US2012/032477 dated Jul. 20, 2012.

* cited by examiner

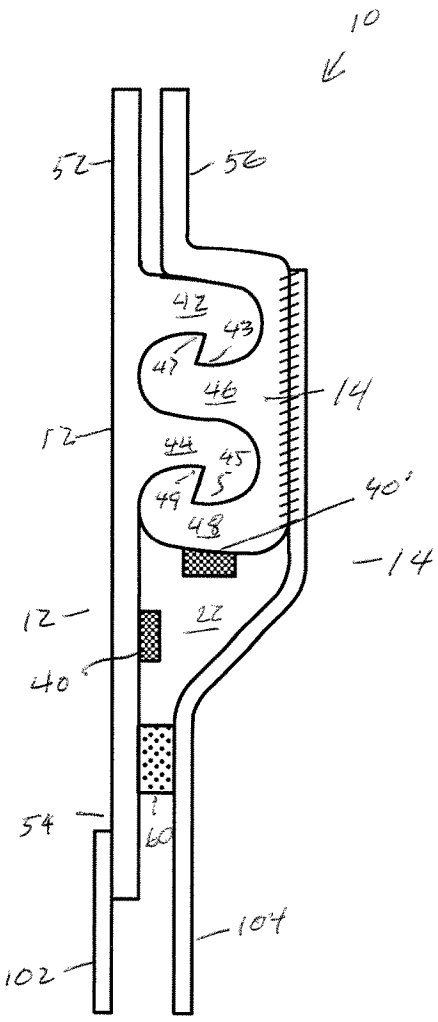
FIG. 6
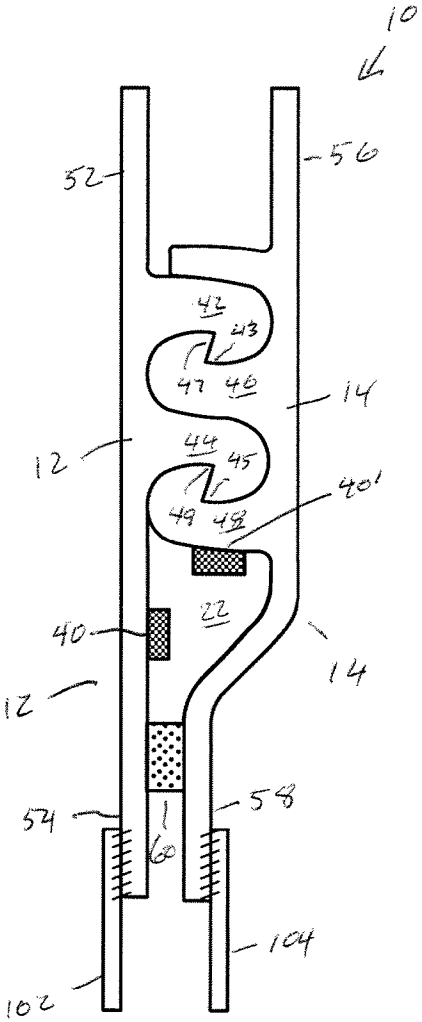
FIG. 5
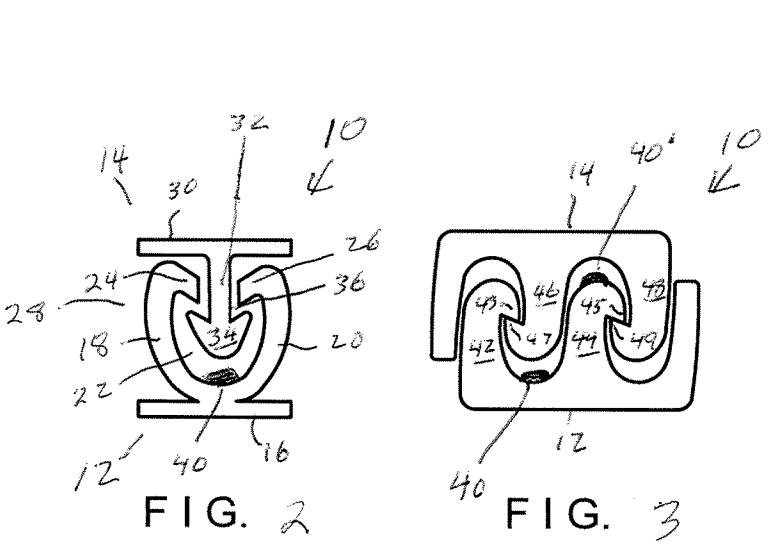
FIG. 3 FIG. 2
FIG. 4

100

RECLOSABLE PACKAGE OR BAG WITH SCENTED ZIPPER

This application is a national phase of PCT/US2012/048987, filed on Jul. 31, 2012, which is a continuation-in-part of PCT/US2012/032477, filed on Apr. 6, 2012, which claims priority under 35 U.S.C. § 119(e) of U.S. provisional application Ser. No. 61/472,437 filed on Apr. 6, 2011 and U.S. provisional application Ser. No. 61/476,390 filed on Apr. 18, 2011, the disclosure of all of which are hereby incorporated by reference in their entirety.

BACKGROUND OF THE DISCLOSURE

Field of the Disclosure

The present disclosure pertains to a reclosable package or bag with a scented or fragrant component, such as, but not limited to, a reclosable zipper, in order to provide an olfactory feedback mechanism that enhances the contents of the package for the user.

Description of the Prior Art

It is well known in the prior art to package scented products in reclosable packages. However, this typically requires a relatively large amount of fragrance-carrying material and further requires the release of the fragrance within the storage volume of the package at the time of initial packaging, which is typically well before the package is opened by the consumer. The prior art further includes U.S. Pat. No. 7,497,623 entitled "Packages with Active Agents", issued on Mar. 3, 2009 to Thomas.

OBJECTS AND SUMMARY OF THE DISCLOSURE

It is therefore an object of the present disclosure to provide a reclosable package or bag wherein fragrance can be provided with a reduced amount of fragrance-carrying material.

It is therefore a further object of the present disclosure to provide a reclosable package or bag wherein the fragrance is not released until the package is opened by the consumer.

This and other objects are obtained by providing a reclosable package or bag wherein the fragrance-carrying material, such as scent oil, is contained within the zipper, typically within an internal zipper volume. The scent remains covered until the zipper is opened. The consumer is exposed to the scent only when the package or bag is opened. The consumer is likewise isolated from the scent when the package is closed.

BRIEF DESCRIPTION OF THE DRAWINGS

Further objects and advantages of the disclosure will become apparent from the following description and from the accompanying drawings, wherein:

FIG. 2 is a cross-sectional view of an embodiment of a zipper profile of the present disclosure.

FIG. 3 is a cross-sectional view of a further embodiment of a zipper profile of the present disclosure.

FIG. 4 is a cross-sectional view of a still further embodiment of a zipper profile of the present disclosure.

FIG. 5 is a cross-sectional view of a further embodiment of a zipper of the profile of the present disclosure, shown with the bag walls of a reclosable package.

FIG. 6 is a cross-sectional view of a variation of the embodiment disclosed in FIG. 5.

DETAILED DESCRIPTION OF THE PREFERRED EMBODIMENTS

Figure 1:
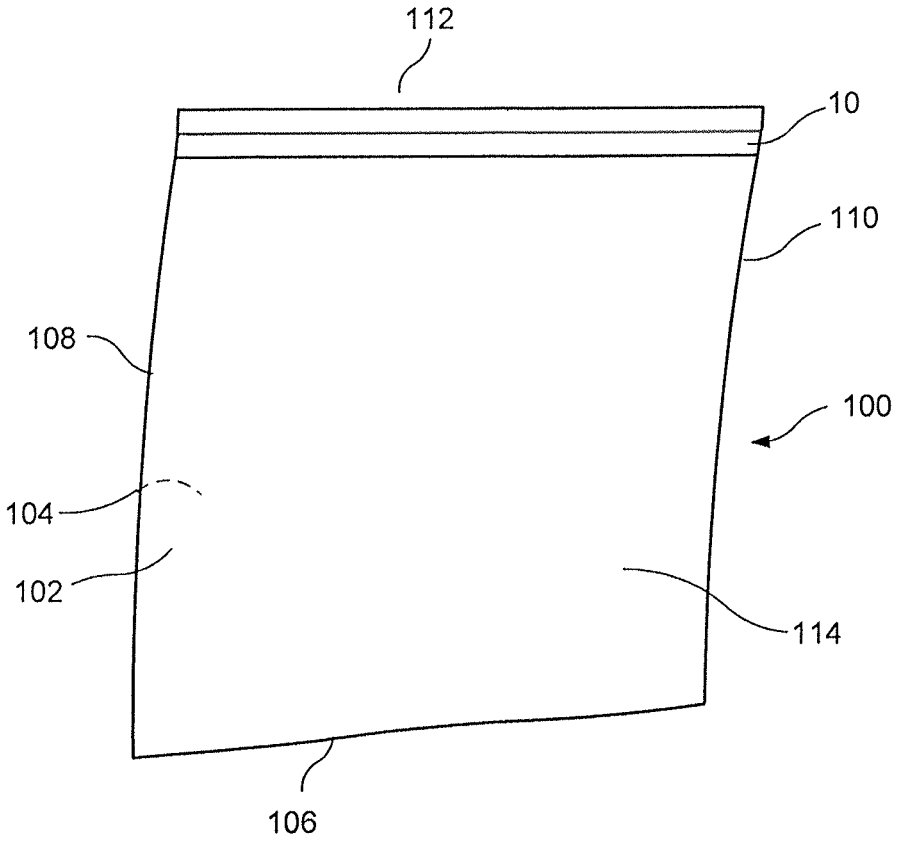
FIG. 1 is a perspective view of a typical reclosable package used with the zippers or reclosures of the present disclosure.

Referring now to the drawings in detail wherein like numerals indicate like elements throughout the several views, one sees that FIG. 1 is a typical reclosable package 100 incorporating the zipper or reclosure 10 of the present disclosure.

The package 100 of FIG. 1 is meant to be illustrative and is representative of many different possible embodiments. Package 100 includes first (front) and second (rear) walls 102, 104 which are co-extensive with each other and are sealed together by bottom seal 106 and side seals 108, 110, which may include thermal, ultrasonic, adhesive or similar seals. Some embodiments may substitute a fold in a single sheet of material for one of the seals, particularly the bottom seal 106. The first and second walls 102, 104 are typically made of polymer or laminate, but are not limited thereto. The resulting structure forms mouth 112 which is reclosable by zipper or reclosure 10, leading to storage volume 114 where the consumer product is stored.

Various embodiments of zipper or reclosure 10 are illustrated in FIGS. 2-13. Zipper 10 is typically formed from polymeric material and includes first profile 12 and second profile 14 which extend across the length of the mouth 112. In the illustrated embodiment, the zipper 10 is attached to the interior of first and second walls 102, 104, but other embodiments may include a zipper which is attached to the upper edge of front and rear walls 102, 104. In the embodiment of FIG. 2, first profile 12 includes first base 16 from which first and second arms 18, 20 extend thereby forming an internal zipper volume 22 therebetween. First and second arms 18, 20 further terminate in respective first and second distal hooks 24, 26 thereby forming an interlocking female element 28. Second profile 14 includes second base 30 with a post 32 extending therefrom, terminating in an arrowhead-shaped element 34 thereby forming an interlocking male element 36 for engagement with the interlocking female element 28.

In FIG. 2, fragrance-carrying oil 40 is placed within internal zipper volume 22 in first profile 12 near the juncture of first base 16 and first and second arms 18, 20. This fragrance-carrying oil 40 could either be blended on the polymer formulation of the zipper 10 (fully or coextruded) or applied in a separate step after formation (such as extrusion) of first and second profiles 12, 14. In this configuration, prior to the opening of the zipper 10 (i.e., the separation of the first and second profiles 12, 14 from each other) the fragrance will be substantially confined within internal zipper volume 22 and will not penetrate into storage volume 114 of the package 100 (see FIG. 1). As it is expected that the fragrance would not escape externally, the fragrance would be expected to last for an extended period. In other embodiments, the fragrance-carrying oil 40 could be applied on a single zipper 10 wherein the intention could be to modify the smell of the packed product or to release the fragrance externally to increase the appeal of the product before the consumer opened the zipper 10.

The fragrance-carrying oil 40, and therefore the scent, is therefore contained within internal zipper volume 22. The scent remains covered until the package 100 is opened by separating the first and second profiles 12, 14 of the zipper 10 (and may be re-covered by closing the package). The resulting advantages include that the scent is used more economically in that the zipper 10, rather than the entire package 100, is scented. Similarly, the shelf-life of the scent is preserved. The consumer is exposed to the scent only when the package 10 is open, and is isolated from the scent when the package 100 is closed.

FIG. 3 illustrates an embodiment wherein first profile 12 includes first and second extending detent arms 42, 44 (terminating in respective first and second detent hooks 43, 45) and second profile 14 includes third and fourth extending detent arms 46, 48 (terminating in respective third and fourth detent hooks 47, 49). The detent arms 42, 44, 46, 48 inter-engage as shown in FIG. 3. Two alternative locations (that is, typically, only one location needs to be used, however, some applications may use both locations) 40, 40' for fragrance-carrying oil are disclosed. Location 40 is at the valley or cavity formed between first and second extending detent arms 42, 44 while location 40' is on the top of second extending detent arm 44.

FIG. 4 illustrates an embodiment wherein first and second detent hooks 43, 45 are oriented outwardly to engage third and fourth detent hooks 47, 49 which are oriented inwardly. Ridge 50 is formed between third and fourth extending detent arms 46, 48, extending into internal zipper volume 22. Two alternative locations 40, 40' for the fragrance-carrying oil are disclosed. Location 40 is on the inverted apex of ridge 50 of second profile 14 while location 40' is on first profile 12, immediately below the inverted apex of ridge 50, within the internal zipper volume 22.

FIGS. 5 and 6 disclose embodiments of flanged zippers 10, similar to the zipper 10 disclosed in FIG. 3. In both FIGS. 5 and 6, first profile 12 includes first customer side flange 52 and first product side flange 54. In FIG. 5, second profile 14 includes second customer side flange 56 and second product side flange 58. In FIG. 6, second customer side flange 56 is provided while second product side flange is eliminated. In FIG. 5, first and second bag walls 102, 104 are sealed to respective first and second product side flanges 54, 58. In FIG. 6, first bag wall 102 is sealed to first product side flange 54 while second bag wall 104 is sealed to second profile 14. In FIG. 5, peel seal 60 is positioned between first and second product side flanges 54, 58 thereby forming internal zipper volume 22 between the peel seal 60 and the interlocking elements. In FIG. 6, peel seal 60 is positioned between first product side flange 54 and second bag wall 104, forming an internal zipper volume 22 similar to that of FIG. 5. In both FIGS. 5 and 6, there are two alternative locations 40, 40' for fragrance-carrying oil. Location 40 is on the first product side flange 54 within internal zipper volume 22. Location 40' is on a lower exterior surface of fourth extending detent arm 48 with internal zipper volume 22.

Figure 7:
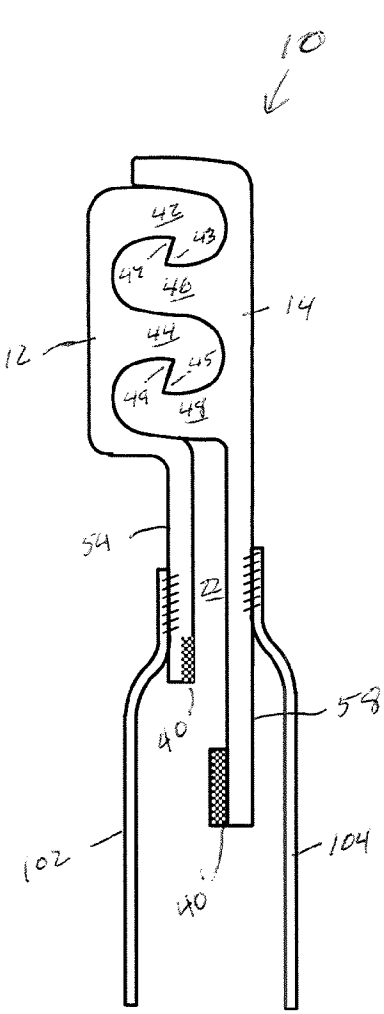
FIG. 7 is a cross-sectional view of a further variation of the embodiment disclosed in FIG. 5.

FIG. 7 is similar to FIG. 5, eliminating first and second consumer side flanges, and extending second product side flange 58. There are two alternative locations 40, 40' for fragrance-carrying oil. Location 40 is on the interior of the tip of first product side flange 54 and location 40' is on the interior of the tip of second (extended) product side flange 58.

Figure 8:
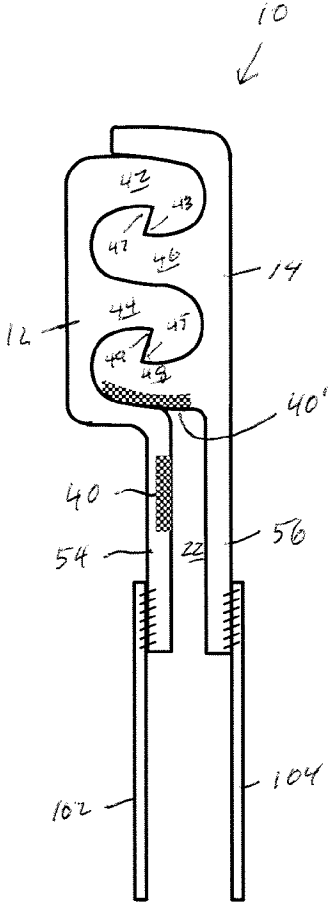
FIG. 8 is a cross-sectional view of a still further variation of the embodiment disclosed in FIG. 5.

FIG. 8 is similar to FIG. 7. Second product side flange 58 is not extended in this figure. There are two alternative locations 40, 40' for fragrance-carrying oil. Location 40 is on first product side flange 54, proximate to the interlocking elements while location 40' is on the lower exterior surface of fourth extending detent arm 48.

Figure 10:
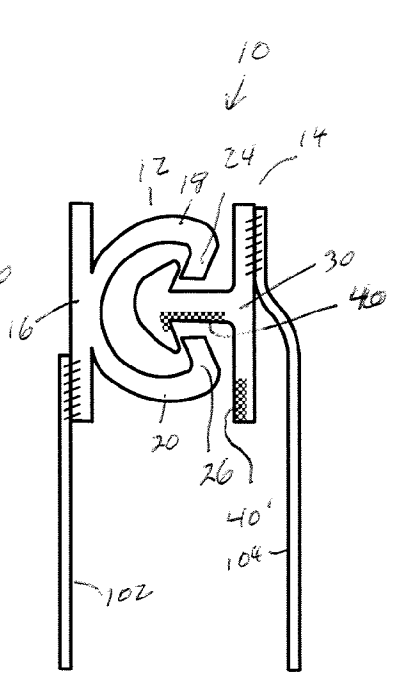
FIG. 10 is a cross-sectional view of a variation of the embodiment disclosed in FIG. 9.
Figure 9:
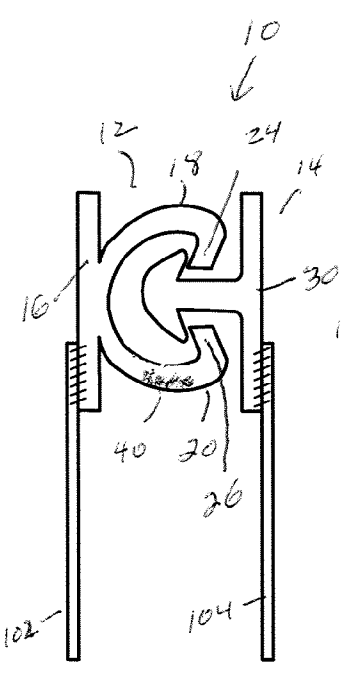
FIG. 9 is a cross-sectional view of a further embodiment of the disclosure, shown with the bag walls of a reclosable package.

FIGS. 9 and 10 illustrate a zipper similar to that of FIG. 2. First and second bag walls 102, 104 are sealed or otherwise attached to respective first and second bases 16, 30. In FIG. 9, the location 40 for the fragrance-carrying oil is on the exterior of second arm 20, oriented toward an interior or product side of the package 100. In FIG. 10, location 40 for the fragrance-carrying oil is on the lower side (i.e., oriented toward the interior) of the interlocking male element 36, while alternative location 40' is on the interior lower side of second base 30.

Figure 11:
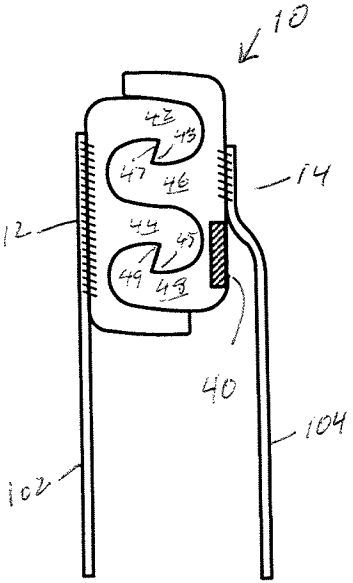
FIG. 11 is a cross-sectional view of a further variation of the disclosure.

FIG. 11 illustrates a zipper 10 similar to that of FIG. 3, with the first and second bag walls 102, 104 sealed or otherwise attached to base portions of the respective first and second profiles 12, 14. There is a product side portion of the second profile 14 which is free of attachment to second bag wall 104 thereby forming a further portion of the interior of bag 100. Location 40 for the fragrance-carrying oil is formed on the exterior of the base portion of the second profile 14 which is free of attachment to the second bag wall 104.

Figure 12:
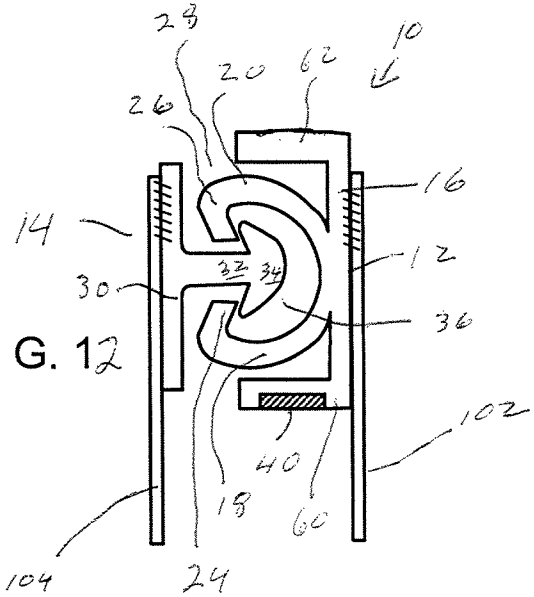
FIG. 12 is a cross-sectional view of a still further variation of the disclosure.

FIG. 12 illustrates a zipper 10 similar to that of FIG. 2, wherein first and second wings 60, 62 are formed outwardly adjacent from respective first and second arms 18, 20. The exterior side of first wing 60 includes the location 40 for the fragrance-carrying oil.

Figure 13:
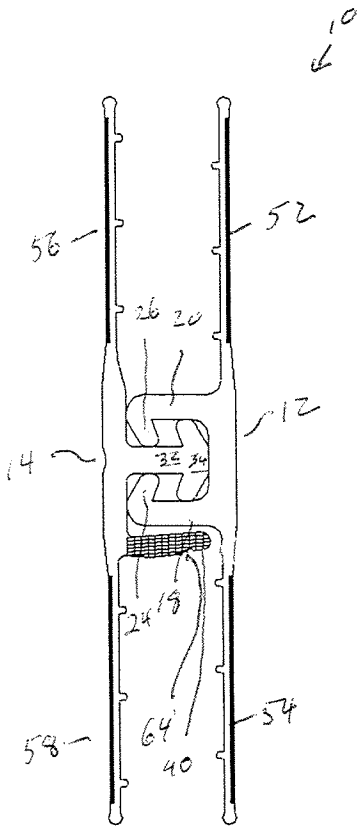
FIG. 13 is a cross-sectional view of yet a still further variation of the disclosure.

FIG. 13 illustrates a zipper 10 similar to that of FIG. 2. Protrusion 64, including fragrance-carrying oil 40, extends from second base 30 so as to be positioned adjacent to first arm 18, within the interior of package 100.

Figure 14:
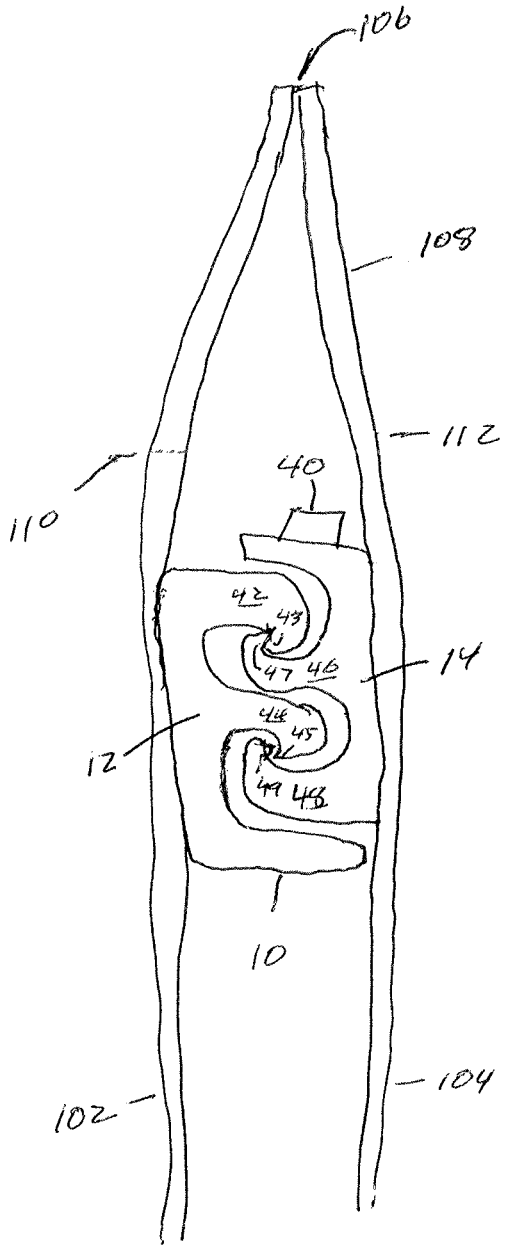
FIG. 14 is a cross-section view of a variation of the disclosure wherein a header is formed over the zipper.

FIG. 14 illustrates an embodiment with a zipper 10 similar to that shown in FIG. 3. First and second bag walls 102, 104 are sealed or otherwise attached to an exterior of first and second profiles 12, 14, respectively and extend over zipper 10 to be joined to each other at seal 106 thereby forming header 108. First and second bag walls 102, 104 include first and second lines of weakness 110, 112, allowing the user to tear off a portion of header 108 thereby gaining access to zipper 10. Fragrance-carrying oil 40 is located on the exterior of second profile 14 so as to be contained within the space of header 108, whereby the fragrance would be released when the user opens or tears off the header 108.

Figure 15:
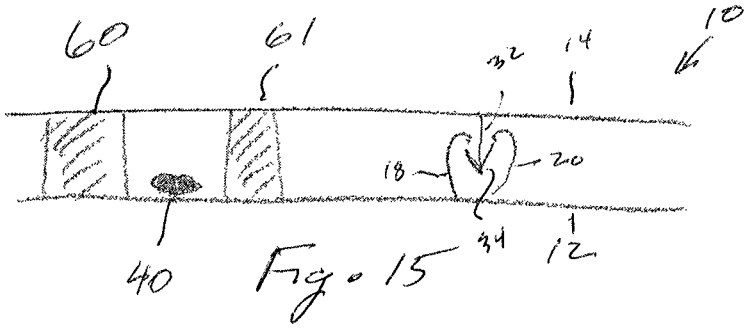
FIG. 15 is a cross-sectional view of an embodiment with fragrance-carrying oil located between two peel seals.
Figure 16:
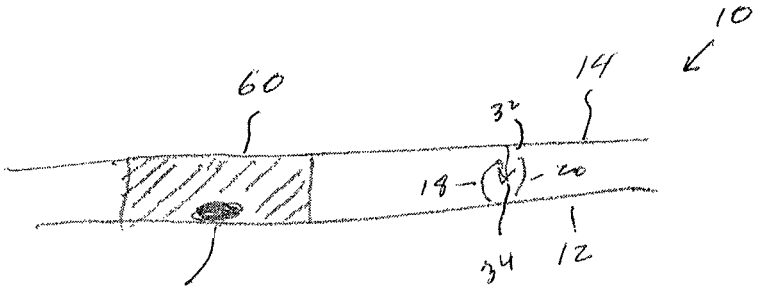
FIG. 16 is a cross-sectional view of an embodiment with fragrance-carrying oil located within a peel seal.
Figure 17:
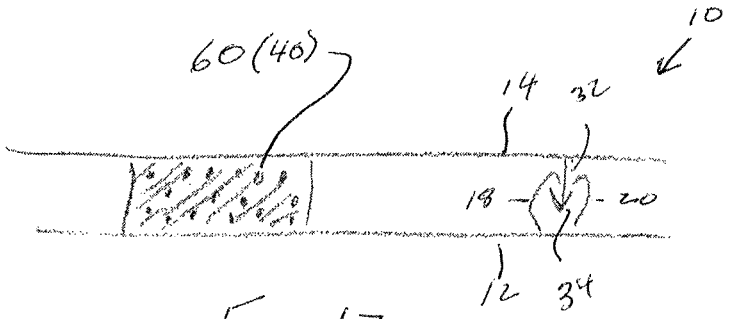
FIG. 17 is a cross-sectional view of an embodiment with fragrance-carrying oil mixed within the peel seal.

FIG. 15 illustrates an embodiment wherein the fragrance-carrying oil 40 is located at a position between closely-spaced first and second peel seals 60, 61. FIG. 16 illustrates an embodiment when the fragrance-carrying oil 40 is a location within the peel seal 60, while FIG. 17 illustrates an embodiment wherein the fragrance-carrying oil 40 is mixed with the material of peel seal 60. Typically, the peel seals 60, 61 are on the product side of the zipper 10.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package including:

a first interlocking profile including a male interlocking structure;

a second interlocking profile including a female interlocking structure, which receives the male structure, and includes an internal zipper volume;

wherein the male interlocking structure interlocks within the female interlocking structure; and a fragrance carrying element within the internal zipper volume.

2. The zipper of claim 1 wherein the fragrance carrying element is located on the female interlocking structure.

3. A zipper for a reclosable package including:

a first interlocking profile with first and second extending detent arms;

a second interlocking profile with third and fourth extending detent arms;

wherein the first extending detent arm interlocks with the third extending detent arm and the second extending detent arms interlocks with the fourth extending detent arm; and a fragrance carrying element formed on one of the extending detent arms.

4. A zipper for a reclosable package including:

a first interlocking profile with first and second extending detent arms and a first product side flange;

a second interlocking profile with third and fourth extending detent arms and a second product side flange;

wherein the first extending detent arm interlocks with the third extending detent arm and the second extending detent arms interlock with the fourth extending detent arm; and a fragrance carrying element formed entirely on a product side of the first and second interlocking profiles and adjacent to and spaced apart from the first and second extending detent arms or adjacent to and spaced apart from the third and fourth extending arms.

5. The zipper of claim 4 wherein the fragrance carrying element is a protrusion including a fragrance carrying oil.

6. A zipper for a reclosable package including:

a first interlocking profile including a first interlocking structure and a first product side flange;

a second interlocking profile including a second interlocking structure and a second product side flange, the second interlocking structure complementary to the first interlocking structure;

the second interlocking profile further including a fragrance carrying structure located entirely on a product side of the second interlocking profile, adjacent to and spaced apart from the second interlocking structure.

7. The zipper of claim 6 wherein the fragrance carrying structure is a protrusion including a fragrance carrying oil.

8. The zipper of claim 6, the second interlocking profile further including a second base, wherein the second interlocking structure extends from the second base, and wherein the fragrance carrying structure separately extends from the second base entirely on the product side of the second interlocking profile.

9. A zipper for a reclosable package including:

a first interlocking profile including a first interlocking structure;

a second interlocking profile including a second interlocking structure;

a peel seal joining the first interlocking profile to the second interlocking profile on a product side of the first and second interlocking structures, thereby forming an internal volume at least partially bounded to the peel seal and the first and second interlocking structures; and at least one fragrance carrying element in the internal volume.

* * * * *